US011910884B2

(12) United States Patent
Edwards

(10) Patent No.: US 11,910,884 B2
(45) Date of Patent: Feb. 27, 2024

(54) LOCK DEVICE FOR APPAREL ITEMS AND ACCESSORIES

(71) Applicant: Roby Edwards, St. Louis, MO (US)

(72) Inventor: Roby Edwards, St. Louis, MO (US)

( * ) Notice: Subject to any disclaimer, the term of this patent is extended or adjusted under 35 U.S.C. 154(b) by 0 days.

(21) Appl. No.: 17/847,492

(22) Filed: Jun. 23, 2022

(65) Prior Publication Data

US 2023/0010187 A1 Jan. 12, 2023

Related U.S. Application Data

(60) Provisional application No. 63/219,049, filed on Jul. 7, 2021.

(51) Int. Cl.
*A43C 7/00* (2006.01)

(52) U.S. Cl.
CPC ..... *A43C 7/00* (2013.01)

(58) Field of Classification Search
CPC ..... A43C 7/005; A43C 7/00; Y10T 24/3708; Y10T 24/3703; Y10T 24/3713; Y10T 24/3716; Y10T 24/3724; Y10T 24/37; Y10T 24/3958; Y10T 24/44974; Y10T 24/3967
See application file for complete search history.

(56) References Cited

U.S. PATENT DOCUMENTS

| | | | | | |
|---|---|---|---|---|---|
| 1,610,925 | A * | 12/1926 | Bryan | A61B 17/30 | 452/82 |
| 3,122,805 | A * | 3/1964 | Hakim | A43C 7/005 | 24/712.3 |
| 3,229,340 | A * | 1/1966 | Herdman | A43C 7/00 | 24/712.3 |
| 3,321,815 | A * | 5/1967 | Herdman | A43C 7/00 | 24/712.3 |
| 2002/0025220 | A1* | 2/2002 | Okuda | G01P 1/026 | 403/374.3 |
| 2016/0047403 | A1* | 2/2016 | Cooley | F16G 11/06 | 24/459 |
| 2020/0054095 | A1* | 2/2020 | McKenzie | A43C 7/04 | |

* cited by examiner

*Primary Examiner* — Robert Sandy
*Assistant Examiner* — Michael S Lee
(74) *Attorney, Agent, or Firm* — Brennan, Manna & Diamond, LLC

(57) ABSTRACT

The present invention relates to a lace, string, strap or zip cord lock or securement device that can be applied to an apparel item or accessory. The device has a threaded cap and threaded housing which attaches to a base. The housing includes a continuous opening through which the laces, strings, straps, or cords can be inserted such that they enter the opening on one side of the housing and exit the opening on the other side of the housing. Then, the cap can be turned to tighten the cap and cause it to move downwards on the housing until the laces, strings, cords or straps are pinned between the cap and the base. In addition, a lace, strap, string or cord insertion tool is provided to aid a user in inserting laces, strings, cord or straps through the continuous opening.

18 Claims, 7 Drawing Sheets

LOCK DEVICE FOR APPAREL ITEMS AND ACCESSORIES

CROSS-REFERENCE TO RELATED APPLICATION

The present application claims priority to, and the benefit of, U.S. Provisional Application No. 63/219,049, which was filed on Jul. 7, 2021 and is incorporated herein by reference in its entirety.

FIELD OF THE INVENTION

The present invention relates generally to the field of shoestring lace, zip tie locks, or securement devices. More specifically, the present invention relates to a shoelace or zip tie lock device that can be applied to any shoe with shoelaces or apparel item having ties or strings which may need to be secured. The device is comprised of a threaded cap and threaded housing which attaches to a base element that is secured to the shoe or apparel item. The housing further includes a continuous opening through which the shoelaces, strings or ties can be inserted through the housing such that they enter the opening of the enclosure on one side of the device and exit an opening on the other side of the device. Then, the cap can be turned to tighten the cap or pressed down to tighten the cap and cause it to move downwards on the housing until the shoelaces are pinned or secured between the cap and the base. Accordingly, the shoelaces are then strapped in a fixed position where they will remain and need not be tied together. In addition, the device may have a shoelace insertion tool that aids a user in inserting shoelaces through the continuous opening. Accordingly, the present disclosure makes specific reference thereto. Nonetheless, it is to be appreciated that aspects of the present invention are also equally applicable to other like applications, devices and methods of manufacture.

BACKGROUND OF THE INVENTION

The United States has a population of around 328 million people, and nearly all of the people regularly wear shoes with shoelaces. Many others have apparel items such as hoodies, pullovers, anoraks, jackets or the like which may have strings, ties or the like in order to secure the apparel item to the individual. However, shoelaces, strings and ties often come untied throughout the course of the day and then must be re-tied. This can be unnecessarily frustrating, especially if a user is performing a task or partaking in activities such as sports, where they may not have the time to continuously retie their shoes or refasten their apparel item. In addition, in certain sporting events such as flag football, the belt supporting the flags it usually tied around the waist of the individual and having a securement device would help prevent the belt from falling off during a game. Apparel accessories such as backpack, also have straps and the like which need to be secured for safe travel. Further, in an effort to ensure their shoelaces or other apparel item stay tied, users may tie their shoelaces, straps or apparel strings extremely tightly. However, this may create an entirely different problem as the user may then struggle to untie the shoelaces, straps, or strings on the apparel item in order to remove the shoes from the feet or clothing from their body.

Further, young and old individuals alike have difficult tying shoelaces, straps, strings and the like. Young children who may be just learning to tie shoes or strings on an apparel item often do not tie the shoelaces or strings properly. As a result, the shoelaces or strings often come untied. Not only does this creating a tripping or other hazard for the child, but it also requires that the child's parent must continuously retie their child's shoes or other garment for their safety, which is unnecessarily burdensome and requires constant monitoring. Further, elderly individuals may have difficulty tying shoelaces for a number of reasons. One of the reasons may include the fact that their hands/fingers may suffer from an arthritic condition, thereby greatly reducing their finger dexterity and preventing them from tying shoelaces or other apparel strings efficiently. Further, elderly individuals may lack the ability to bend down for long periods of time in order to tie shoes or strings on their apparel items.

Therefore, there exists a long-felt need in the art for a shoelace, string, strap, zip tie lock device or other securement feature that allows a user to easily tie and untie shoes or other apparel items or accessories. Further, there exists a long-felt need in the art for a shoelace, string, strap or zip tie lock device that does not require a substantial amount of dexterity or skill to allow a user to tie or untie a shoe or apparel item. In addition, there exists a long-felt need in the art for a shoelace, string, strap, zip tie lock device that can be universally applied to any pair of shoes, apparel item or accessory which have shoelaces, strings, straps, zip ties or combinations thereof.

The subject matter disclosed and claimed herein, in one embodiment thereof, comprises a shoelace, string, strap, zip tie lock or securement device. The device is comprised of a rotatable or depressible cap that is received by a cylindrical housing and base. The cap and housing engage one another via a plurality of threads or rails such that the cap can be rotated around or depressed into the housing to raise/lower the cap on the housing. The housing further includes a continuous opening in which the shoelaces, strings, straps, zip ties or combinations thereof can be inserted through the housing via an opening sized and configured to receive the element for securing the apparel item or accessory. Once shoelaces, strings, straps, or zip ties have been inserted through the opening in the housing, a user may then twist or press down the cap such that the cap moves downwards on the base and secures the shoelaces, strings, straps, or zip ties in place by pinning them between the cap and the base. The base may also include a locking pin that ensures that the cap and housing of the device remain secured together.

In this manner, the lock or securement device of the present invention accomplishes all of the forgoing objectives and provides an easy means for a user to tie shoelaces strings, straps, or zip ties and keep the items tied throughout the day. Further, the device does not require extreme dexterity or skill to operate, thus allowing the device to be used by children and elderly persons alike. In addition, the device can be universally applied to any pair of shoes, apparel items, accessories, sporting equipment or other items having laces, strings, straps or zip ties that need to be tied together, making it extremely versatile and desirable for users.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a securement or lock device for laces, strings, straps or zip ties. The device preferably includes a cap or top that contains interior threads or rails and a base which is fixedly attached with a cylindrical housing that contains corresponding mating threads or rails. Further, the side surfaces of the housing have a continuous opening that receives shoelaces strings, straps or zip ties to allow the laces, strings, straps or zip ties to be placed through the opening in the housing. The cap is also preferably cylindrical in shape and is of a size such that it fits over the cylindrical housing. The side surfaces of the cap may further include a plurality of grooves that allow a user to more easily grip, depress and/or turn the cap. In addition, the cap has a lip and a recessed area that receives a retaining pin assembly. The retaining pin assembly is fixedly attached to the base, and ensures that the cap can be twisted or pulled upwards along the housing such that the cap's upward movement is limited by the pin to the last point where the cap can still remain attached to the housing. This then ensures that the housing and cap cannot be separated during use.

The housing is generally cylindrical in shape and is fixedly attached to a round base. As noted, a portion of the side surface of the housing contains threads or rails that allow the cap to travel upwards/downwards on the housing via a user turning the cap clockwise or counterclockwise or depressing it so that the cap moves. A portion of the housing side surface includes a smooth area that has a continuous opening that runs through the housing. The continuous opening allows laces, strings, straps or zip ties to be inserted through the housing such that the laces, strings, straps or zip ties enter through one side of the housing and exit on the other side of the housing.

Accordingly, once the laces, strings, straps or zip ties have been completely fed through the continuous opening, the cap can be twisted clockwise or depressed to tighten the cap and cause it to travel downwards until the bottom surface of the lip pins the laces against the top surface of the base. To this effect, the laces, strings, straps, or zip ties are now retained within the device at whatever tightness or looseness the user placed the laces, strings, straps or zip ties through the continuous opening. Therefore, a user need not adjust, tie or retie his or her shoes, apparel or accessory items throughout the day. Further, a user can simply turn the cap counterclockwise to allow the cap to loosen and travel upwards to loosen the laces, strings, straps or zip ties as desired.

In the event that a user has difficulty inserting the laces, strings, straps or zip ties through the continuous opening, the device may also include a lace or string insertion tool. The tool has a cylindrical body and the second end of the body has a round spring coil. Attached to the spring coil is a grabber that has two textured plates. Accordingly, a user can press on the rear area of each plate to open the grabber, and then release each plate to close the grabber around one or two laces or strings. Once the laces or strings are attached to the device, the long body can then be easily inserted into the continuous opening of the device. Then, once the tool and laces or strings are through the opening on the second side of the device, the tool can be disengaged by once more pressing the rear areas of the plates to allow the laces or strings to be removed from the grabber.

Accordingly, the improved lace, string, strap or zip tie lock or securement device of the present invention is particularly advantageous as it allows a user to have tight laces, strings, straps or zip ties that cannot come loose during the day, and especially during activities. Further, the device eliminates the need for a user to physically tie laces, strings, straps or zip ties, which is advantageous to young and elderly users alike. In addition, the device can universally be used on any pair of shoes with laces, or other apparel items or accessories having strings, straps, zips or the like, thereby making it extremely versatile and desirable for users.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE INVENTION

Figure 1A:
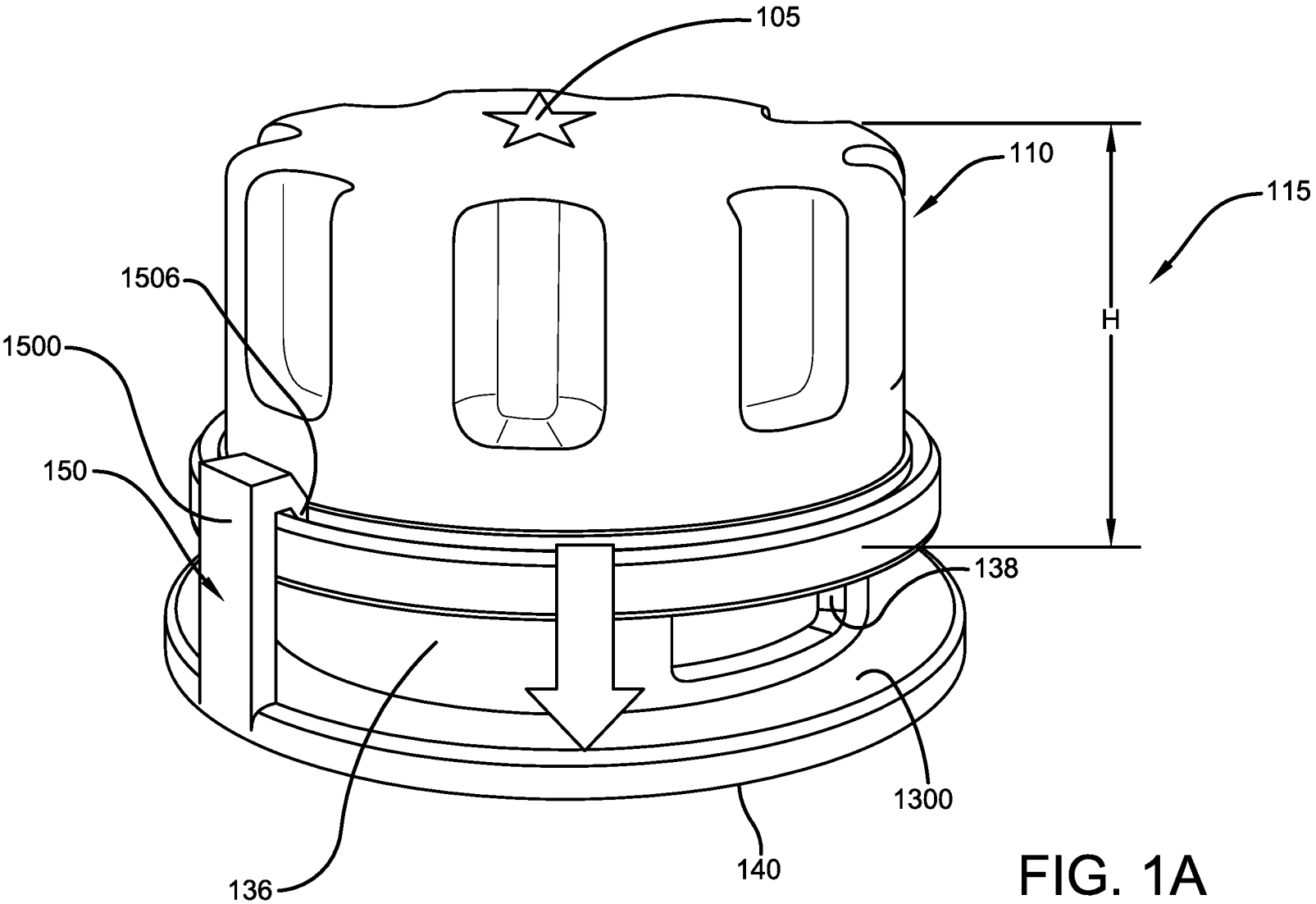
FIG. 1A illustrates a perspective view of one potential embodiment of a laces, strings, straps, or zip ties lock or securement device of the present invention in an unlocked position in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a laces, strings, straps or zip ties lock or securement device that allows a user to easily tie and untie shoes, apparel items, sporting equipment or other accessories. Further, there exists a long-felt need in the art for a laces, strings, straps or zip ties lock or securement device that does not require a great amount of dexterity or skill on behalf of the user that is required for the user to tie or untie the laces, strings, straps or zip ties. In addition, there exists a long-felt need in the art for a laces, strings, straps or zip ties lock or securement device that could be universally applied to any pair of shoes, apparel items, sporting goods or accessories which have laces, strings, straps or zip ties, such that the laces remained tied throughout the day at whatever tightness or looseness the user desires.

The subject matter disclosed and claimed herein, in one embodiment thereof, comprises a laces, strings, straps or zip ties lock or securement device. The device preferably comprises a cap that contains interior threads or rails and a base that has a fixedly attached cylindrical housing that contains opposing threads or rails to that which is disposed in the cap. The housing further includes a continuous opening that receives laces, strings, straps or zip ties. The cap of the device is also preferably cylindrical in shape and is of a size such that it fits over the cylindrical housing. Further, the side surfaces of the cap may have a plurality of grooves that allow a user to more easily grip and turn or depress the cap to operate the device. The cap also has a lip and a recessed area that receives a retaining pin assembly that is fixedly attached to the base. The retaining pin assembly then ensures that the cap can be twisted upwards along the housing such that the caps upward movement is limited by the pin to the last point such that the cap can still be attached to housing. In this manner, the pin then ensures that the housing and cap cannot separate during use.

The housing of the device is preferably generally cylindrical in shape and is fixedly attached to a round base as noted. A portion of the side surface of the housing further includes female threads which allow the cap to travel upwards or downwards on the housing when a user turns the cap clockwise or counterclockwise or depresses the cap downwardly and again to release the cap so that it comes up. A portion of the housing side surface also contains a smooth area that has a continuous opening that runs through the housing. The continuous opening allows laces, strings, straps, or zip ties to be inserted through the openings in the housing such that the laces, strings, straps, or zip ties enter through one side of the housing and exits on the other side of the housing. Accordingly, once the laces, strings, straps or zip ties have been completely fed through the continuous opening, the cap can be twisted clockwise or depressed to tighten the cap and cause it to travel downwards until the bottom surface of the lip pins the laces, strings, straps, or zip ties against the top surface of the base. Thus, the laces, strings, straps or zip ties are now retained within the device at whatever tightness or looseness the user placed the laces, strings, straps, or zip ties into the device at. As a result, a user need not adjust, tie, or retie their shoes throughout the day. Further, a user needs only to turn the cap counterclockwise or depress the cap again to allow the cap to loosen and travel upwards to loosen the laces, strings, straps or zip ties as desired.

Furthermore, the device may also have a laces, strings, straps or zip ties insertion tool. The tool is comprised of a cylindrical body in which the second end of the body has a round spring coil with an attached grabber that has two textured plates. To use the grabber, a user can press on the rear area of each plate to open the grabber and then release each plate to close the grabber around one or two laces, strings, straps or zip ties. Once the laces, strings, straps or zip ties are attached to the device, the long body can then be easily inserted into the continuous opening of the device. Once the tool and laces, strings, straps or zip ties are through the opening on the second side of the device, the tool can then be disengaged from the laces, strings, straps or zip ties by pressing the rear areas of the plates to allow the laces, strings, straps or zip ties to be removed from the grabber.

Accordingly, the improved laces, strings, straps or zip ties lock of the present invention is particularly advantageous as it allows a user to have tight laces, strings, straps or zip ties that cannot come loose during the day or during various activities. Further, the device eliminates the need for a user to physically tie laces, strings, straps or zip ties, which is advantageous to young and elderly users alike who as already has noted may have extreme difficult in tying shoes. In addition, the device can be universally used on any pair of shoes, apparel or other accessories with laces, strings, straps, or zip ties, making it extremely versatile from a consumer perspective.

Referring initially to the drawings, FIG. 1A illustrates a perspective view of one potential embodiment of a laces, strings, straps or zip ties lock or securement device 100 of the present invention in an unlocked position in accordance with the disclosed structure. In the preferred embodiment, the laces, strings, straps or zip ties lock or securement device 100 includes a cap 110 that contains interior threads or rails 118 and a base 130 that has a fixedly attached cylindrical housing 132 and a flat bottom surface 140. The continuous side surface 136 of the housing 132 has opposing threads or rails 156, and also includes a continuous opening 138 that receives laces 10. Further, the base 130 has a fixedly-attached retaining pin assembly 150. It is contemplated that all components of the device 100 are preferably made from a rigid plastic such as acrylic, polycarbonate, polyethylene, thermoplastic, acrylonitrile butadiene styrene, low density polyethylene, medium density polyethylene, high density polyethylene, polyethylene terephthalate, polyvinyl chloride, polystyrene, polylactic acid, acetal, nylon, fiberglass, 3D-printed plastic, etc. unless otherwise indicated. In differing embodiments, any surface of the device 100 may have a plurality of colors, designs, patterns, textures, logos, images, emblems, etc. (see numeral 105 in FIGS. 1 and 300 in FIG. 3)

The cap 110 of the device 100 is preferably cylindrical in shape and is comprised of a flat top surface 112 and a continuous side surface 114. The side surface 114 may also have a plurality of grooves 1140 that may run the entire height 115 or only a portion of the height 115 of the side surface 114. The grooves 1140 allow a user to more easily grasp the cap 110 to operate the device 100. The cap 110 also has a lip 116 that is greater in diameter than the top surface 112. The lip 116 further includes a recessed area 1160 between the lip 116 and side surface 114 that is in contact with a retaining pin assembly 150 to secure the cap 110 to the housing 132, as will be explained more fully below. The cap 110 includes a graphic or other indicia 105 which is shown on the top surface of the cap.

Figure 1B:
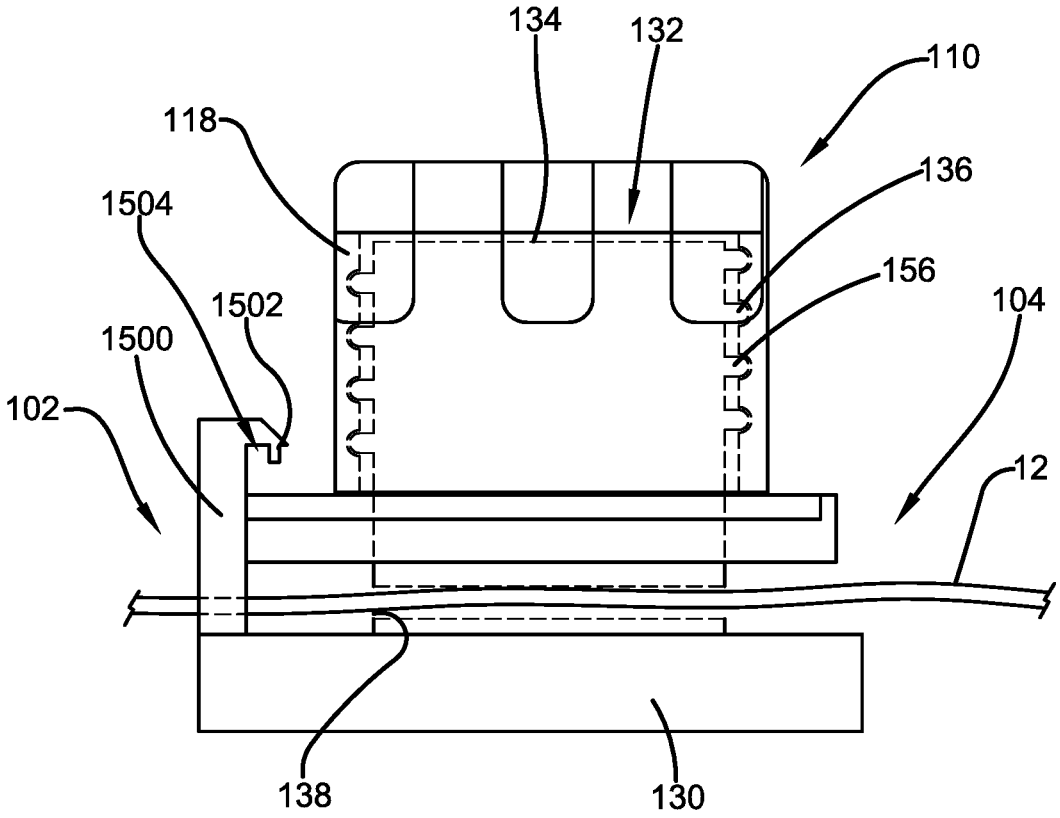
FIG. 1B shows a cross-sectional view of one potential embodiment of a laces, strings, straps or zip ties lock or securement device of the present invention in an unlocked position while attached to a laces, strings, straps or zip ties in accordance with the disclosed architecture.

As noted, the device 100 also has a base 130 that contains a fixedly attached, cylindrical housing 132. The housing 132 has a flat top surface 134 that is smaller in diameter than the top surface 112 of the cap 110, such that the housing 132 can fit inside the cap 110 as best seen in FIG. 1B which illustrates a cross-sectional view of one potential embodiment of a lace or string lock device 100 of the present invention in an unlocked position while attached to a pair of shoelaces 12. Accordingly, a portion of the continuous side surface 136 (e.g. the portion that remains within the cap 110) of the housing 132, preferably threads or rails 156, that engage corresponding threads or rails 118 located on the interior of the cap 110. In this manner, the cap 110 can be rotated clockwise or depressed to tighten the cap 110 (and move the cap 110 downward on the housing 132) or can be rotated counterclockwise or again depressed to release a spring or other tension mechanism to loosen the cap 110 (and move the cap 110 upward on the housing 132). However, a portion of the housing 132 near the base 130 preferably has no threads 156 (e.g. that portion of the housing 132 is smooth) and instead has a smooth side surface 136 that has a continuous opening 138. As best seen in FIG. 1B, a shoelace, string, tie, strap or the like 12 can be inserted through the opening 138 on the first side 102 of the device 100 such that the lace or string 12 runs through the housing 132 and out the opening 138 on the second side 104 of the housing of the device 100.

The securement device 100 for apparel and accessories, which is disclosed herein, includes first 110 and second 130 locking components, each of the first and second locking components having cooperating locking elements 118 and 156. The locking element of the first locking component engages with the locking element of the second locking component. Each of the first and second locking components having a housing 132 and 133, with each housing having first and second openings 136 and 138 and the cooperating locking elements secure one of laces, strings, straps, zip ties or combinations thereof between the first and second locking components.

Figure 2:
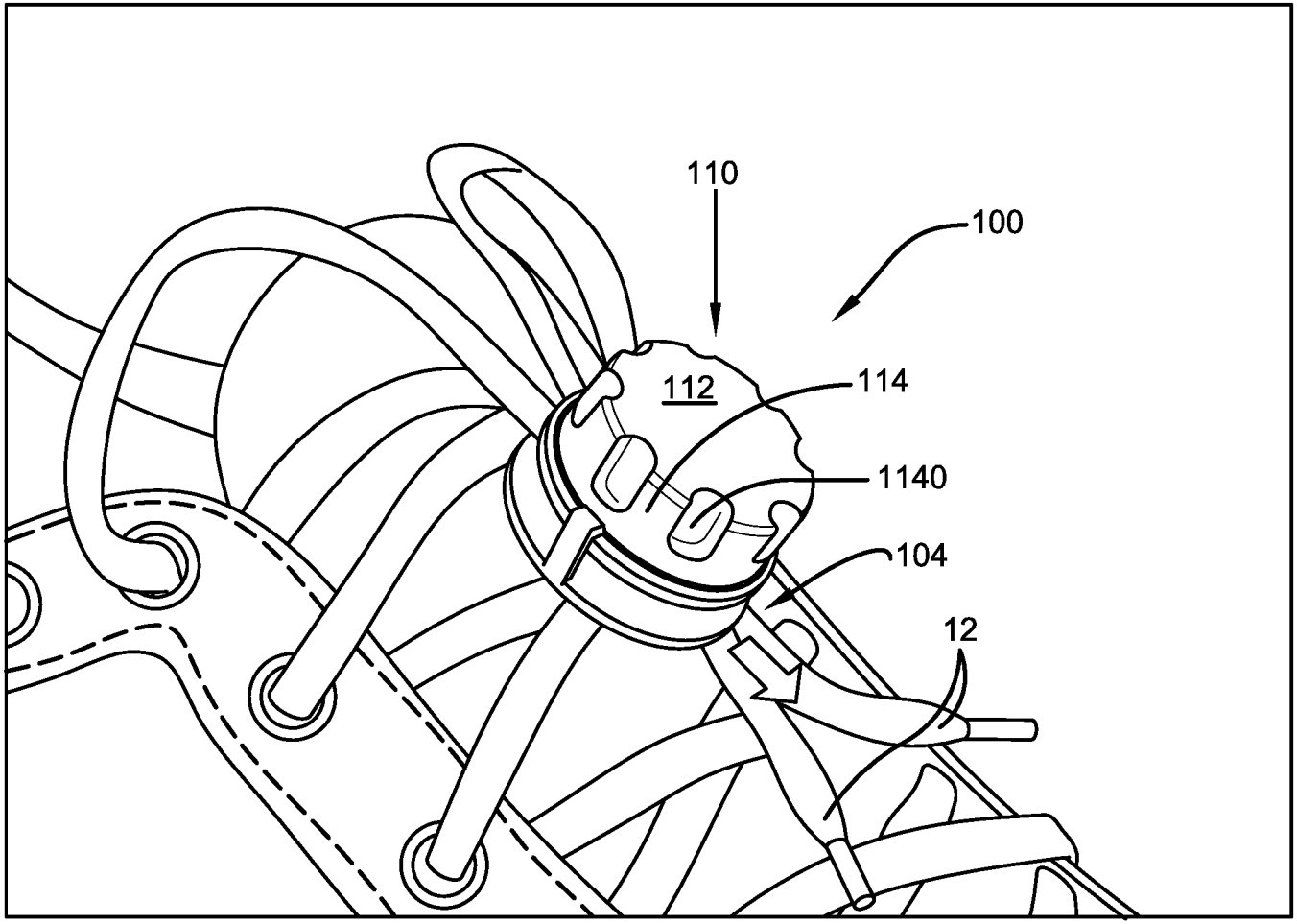
FIG. 2 provides a perspective view of one potential embodiment of a laces, strings, straps or zip ties lock engagement device of the present invention in a locked position while attached to a pair of laces, strings, straps or zip ties in accordance with the disclosed architecture.

FIG. 2 illustrates a perspective view of one potential embodiment of a lace or string lock or securement device 100 of the present invention in a locked position while attached to a pair of laces, strings, straps or the like 12. In this figure, it can be observed fully how a lace or string 12 is fed through the continuous opening 138 at one side of the housing of the device 100 and exits the opening 138 on the other side of the housing of the device 100. Therefore, a portion of the lace or string 12 preferably still hangs out of the opening 138 on the second side 104 of the housing of the device 100.

Figure 3:
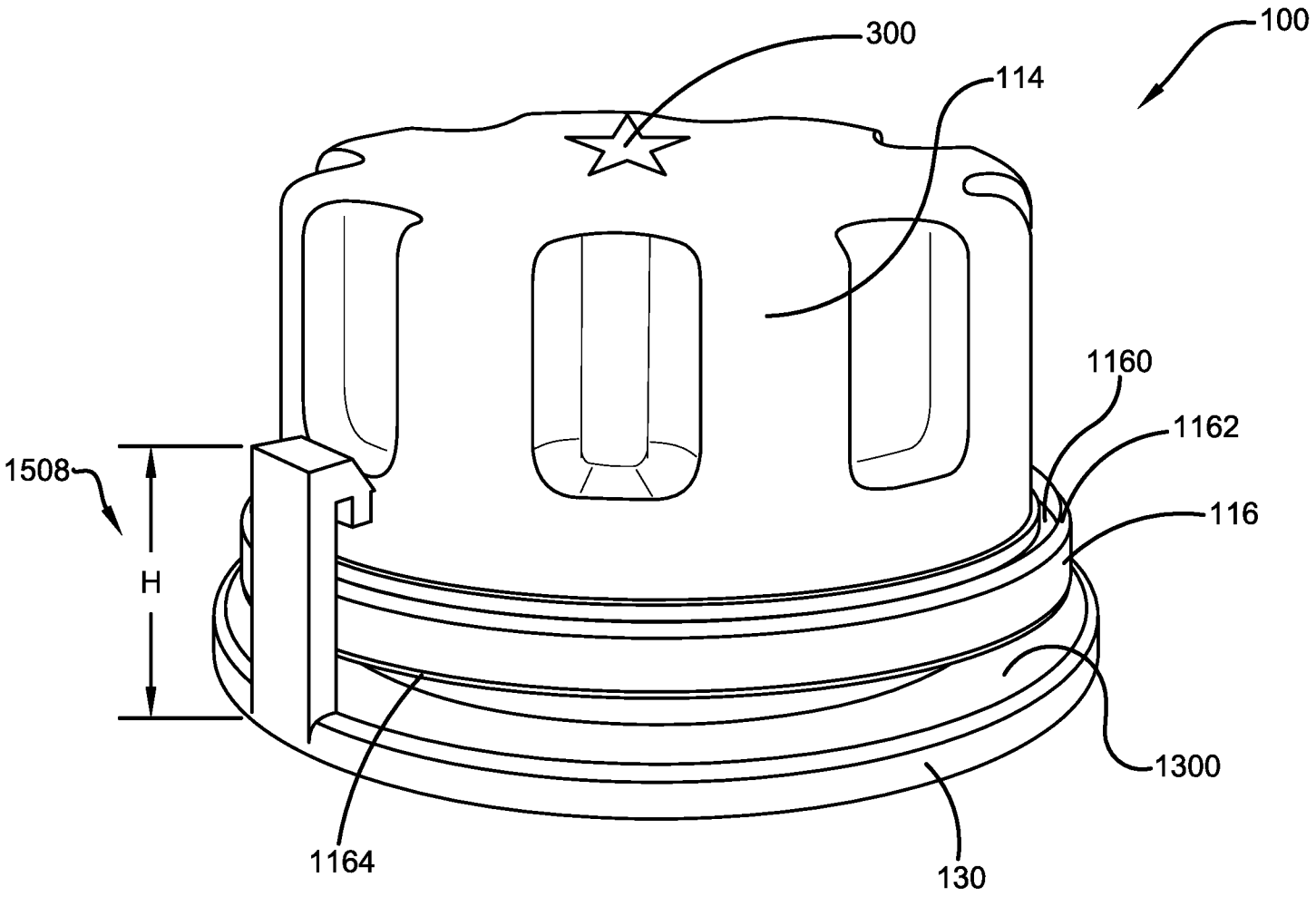
FIG. 3 displays a perspective view of one potential embodiment of a laces, strings, straps or zip ties lock or securement device of the present invention in a locked position in accordance with the disclosed architecture.

After laces or strings 12 have been fed through the opening in the housing 138, the device 100 can be placed in a locked or secured position which can be observed in FIGS. 2 and 3. FIG. 3 illustrates a perspective view of one potential embodiment of a lace or string lock device 100 of the present invention in a locked position and FIG. 2 illustrates a perspective view of one potential embodiment of a shoelace lock or securement device 100 of the present invention in a locked position while attached to a pair of shoelaces 12 and shoes 10. As noted, to tighten or lock the device 100, a user needs only to rotate or depress the cap 110 clockwise to tighten the cap 110. When this tightening occurs, the cap 110 moves downward on the housing 132 as the opposing threads 118 of the cap 110 continue to engage the corresponding threads 156 of the housing 132. A user can then continue to tighten the cap 110 such that the lip 116 of the cap 110 covers the continuous opening 138 of the housing 132. In this regard, shoelaces, strings, straps or the like 12 within the opening 138 will be pinned and secured between the bottom surface 1164 of the lip 116 and the top surface 1300 of the base 130 (as shown in FIG. 2). Therefore, the shoelace, straps, strings or the like 12 can no longer move through the opening 138 and will remain at whatever tightness or looseness the user has fed the shoelace 12 through the opening with 138. Conversely, a user can loosen the cap 110 by rotating it counterclockwise, which moves the cap 110 upward on the housing 132 as the threads 118 of the cap 110 continue to disengage the corresponding threads 156 of the housing 132. In this manner, the cap 110 can be raised such that shoelaces, strings, straps or the like 12 can be removed or tension can be taken off the shoelaces or strings 12 to allow them to have a looser fit.

As also noted above, the base 130 includes a retaining pin assembly 150 that ensures the cap 110 cannot separate from the base 130 or housing 132. The pin 150 is preferably fixedly attached to the base 130, and has a vertical member 1500, an angled member 1502, a grooved member 1504, and a tongue member 1506. As best shown in FIG. 1A, the retaining pin 150 inhibits or stops the movement of the cap 110 such that the threads of the cap 110 cannot completely disengage the corresponding threads 156 of the housing 132 to allow the cap 110 to completely separate from the housing 132. To accomplish this, the vertical member 1500 is of a specific height such that the height 1508 of the member 1500 corresponds to the maximum height that the cap 110 can be positioned on the housing 132 such that the housing 132 and cap 110 are still attached to or engaged with one another to create a secure engagement. The locking pin 150 further includes an angled member 1502 that forms a groove 1504 and also has a tongue 1506. The groove 1504 is then received by the top surface 1161 of the lip 116 such that the upwards movement of the cap 110 is further limited to the last point wherein the cap 110 can remain attached to or engaged with the housing 132. In addition, the tongue 1506 engages the recessed area 1160 such that is becomes pinned between the side surface 114 and the lip 116 to further inhibit the upward movement of the cap 110 to ensure the cap 110 remains connected to the housing 132.

Figure 4:
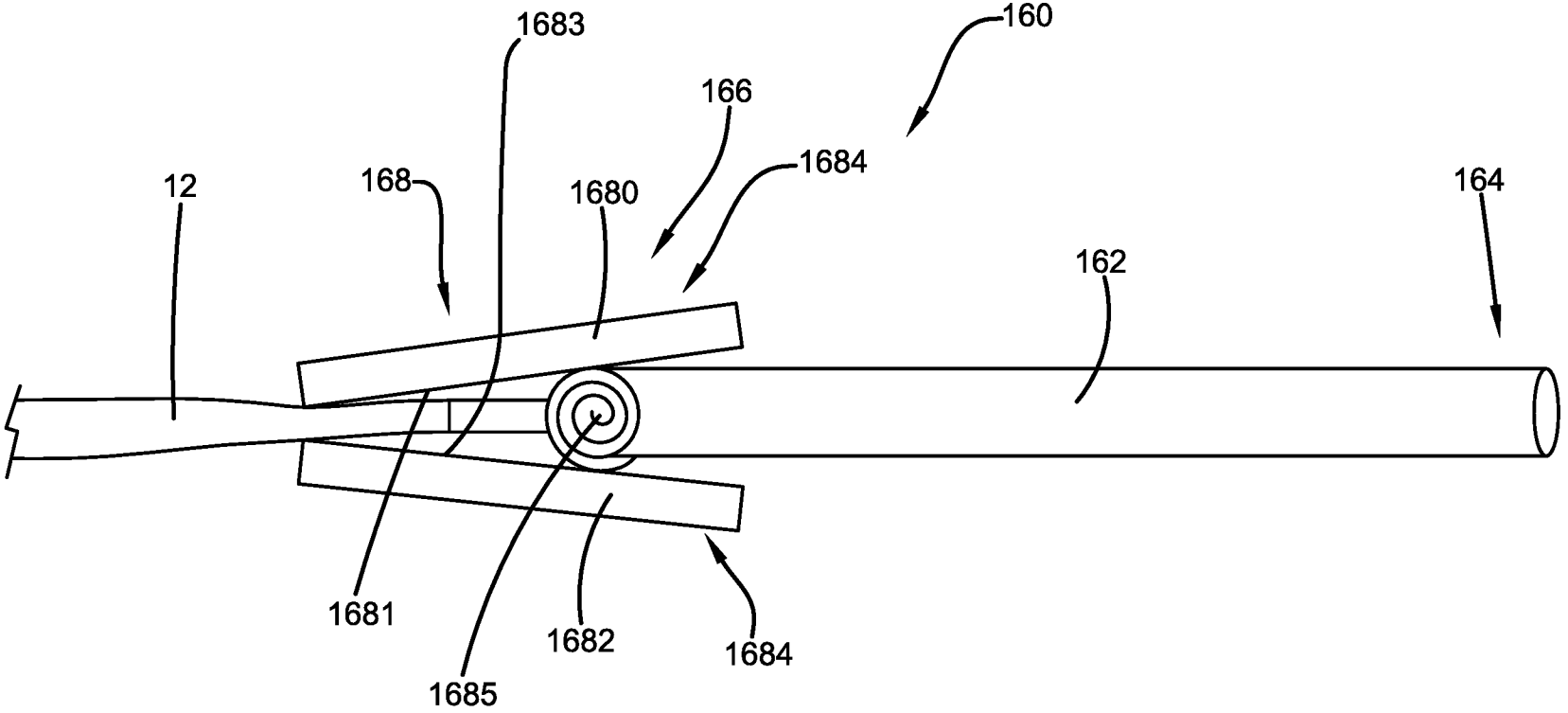
FIG. 4 illustrates a perspective view of one potential embodiment of a laces, strings, straps, or zip ties insertion tool of a laces, strings, straps or zip ties lock device of the present invention in accordance with the disclosed architecture.

FIG. 4 illustrates a perspective view of one potential embodiment of lace, string or strap insertion tool 160 of a lace lock or securement device 100 of the present invention. In an instance where a user still has difficulty inserting the shoelaces 12 into the continuous opening 138, the device 100 may also be provided with an insertion tool 160 which is used to insert the strings, laces, straps, zip ties or the like in the openings of the housing. The tool 160 has a generally cylindrical, long body 162 that is of a size and shape that can fit into the continuous opening 138. The body 162 has a first end 164 and a second end 166 in which the second end 166 is an end 168 configured to grab a lace, string or the like. The grabber 168 end has a first plate 1680 and a second plate 1682 which may have a rough-textured interior surface 1681, 1683 that promotes a good grip. Further, the plates 1680, 1682 are attached via a round spring coil 1685 such that the plates 1680, 1682 can be opened or closed around a lace, string, strap, zip tie or combinations thereof 12 via pressing down or releasing on the rear area 1684 of both plates 1680, 1682. In this manner, the tool 160 can be firmly attached to one or a pair of shoelaces or other strings, straps or the like 12, such that the user can use the long body 162 of the tool 160 to easily insert the tool 160 and shoelaces 12 completely through the continuous opening 132. Then, once the shoelaces, strings, straps, or the like 12 and tool 160 have passed through the opening and are on the second side 104 of the device 100, the tool 160 can be removed from the shoelaces 12 via pressing down on both plates 1680, 1682. As a result, the shoelaces 12 and device 100 are ready to use and be set at the appropriate tightness or looseness by a user. Further, it is contemplated that a user need only use the tool 160 to insert the shoelaces, strings, straps or the like 12 through the device 100 only once during the use of the device 100, on one pair of shoes 10 or other apparel item or accessory. This is due to the fact that the shoelaces, strings, straps, zip ties or combinations thereof 12 will be securely retained within the device 100 such that the device 100 can be left attached to the shoelaces, strings, straps, zip ties or the like 12 of any shoe 10 or other apparel item or accessory for any desirable period of time. In differing embodiments, any surface of the tool 160 may also be comprised of a plurality of colors, designs, patterns, textures, logos, images, emblems, etc.

Figure 5:
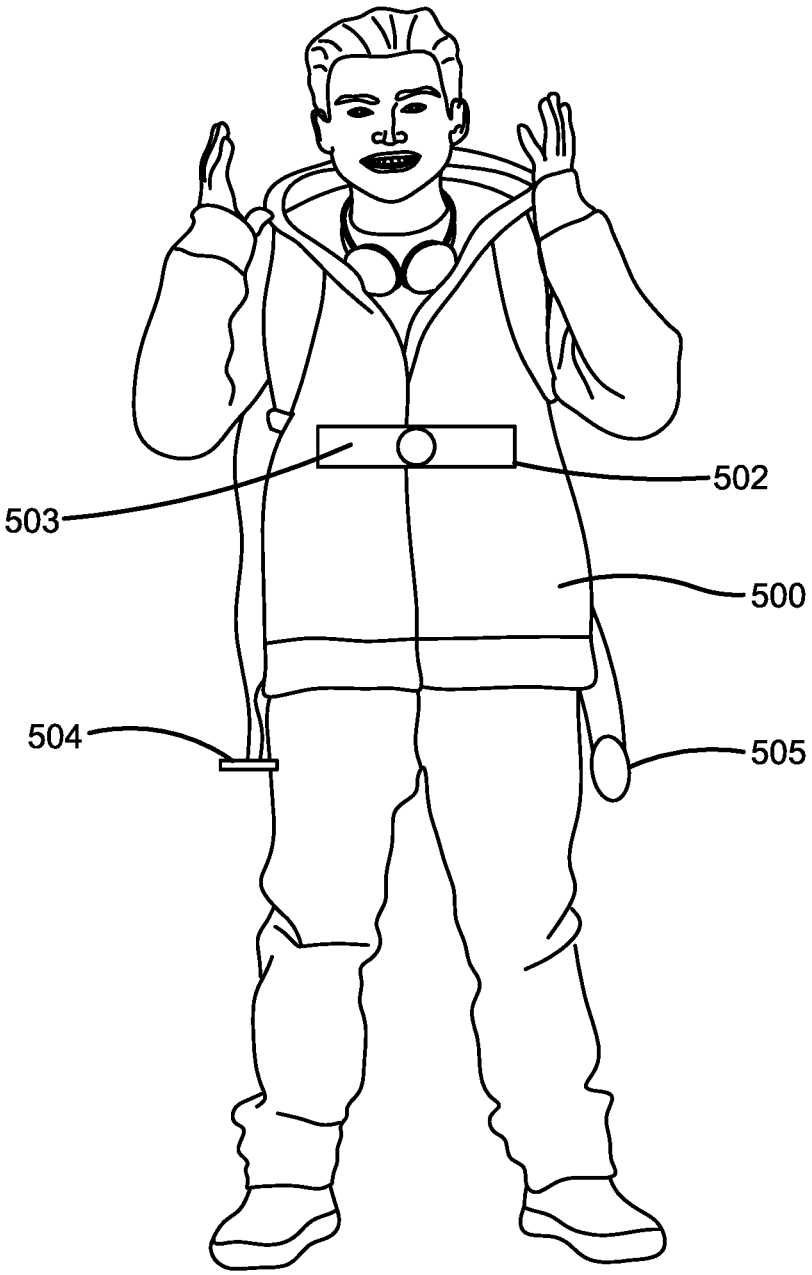
FIG. 5 illustrates a perspective view of one potential embodiment of an apparel accessory with the lock or securement device of the present invention in accordance with the disclosed architecture.

FIG. 5 shows the locking or securement device 505 and 503 used with an apparel accessory such as a backpack 500. The backpack has various straps 504 and 502 which are secured together by the locking or securement device to hold the straps in a comfortable position and secure the backpack to the user. FIG. 5 illustrates that one or more securement or locking devices can be used with an apparel item or accessory.

Figure 6:
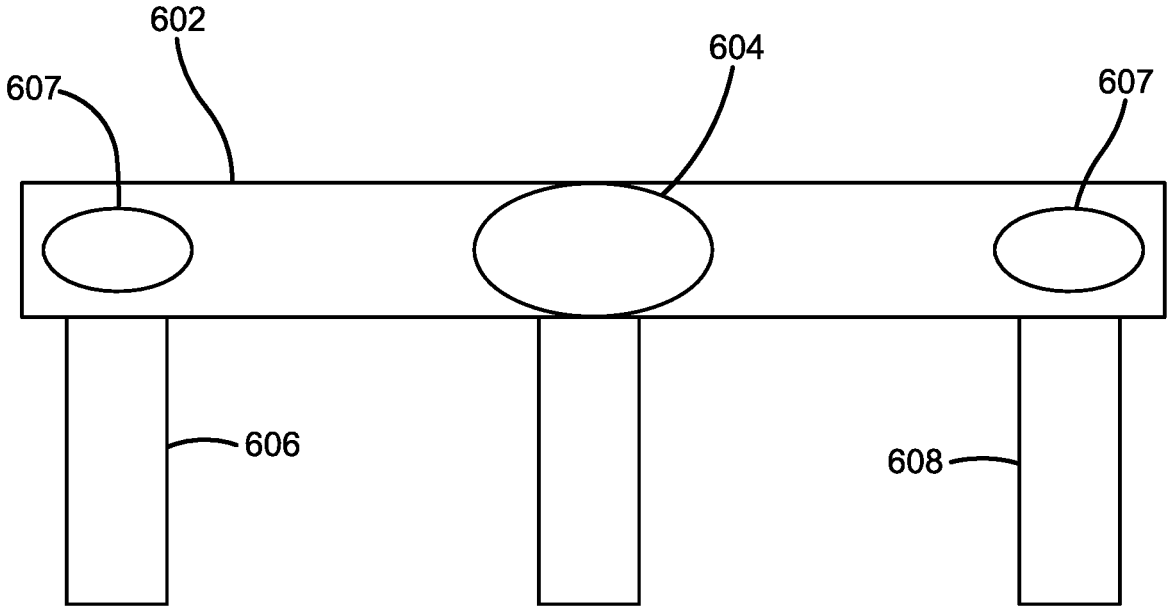
FIG. 6 illustrates a perspective view of one potential embodiment of a sporting accessory with the lock or securement device of the present invention in accordance with the disclosed architecture.

FIG. 6 provides a further exemplary use of the present invention in which an apparel accessory, here a flag football belt 602 is depicted having multiple locking elements 604 and 607. The locking elements 607 are connected to the flags 606 and 608, in this way the locking elements can be adjusted to set the security of the flags making them more or less difficult to remove from the belt, and call the player down and the play over.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "shoelace lock device" and "device", are interchangeable and refer to the shoelace lock device 100 of the present invention.

Notwithstanding the forgoing, the shoelace lock device 100 of the present invention and its various components can be of any suitable size and configuration as is known in the art without affecting the overall concept of the invention, provided that they accomplish the above-stated objectives. One of ordinary skill in the art will appreciate that the size, configuration and material of the shoelace lock device 100 as shown in the FIGS. are for illustrative purposes only, and that many other sizes and shapes of the shoelace lock device 100 are well within the scope of the present disclosure. Although the dimensions of the shoelace lock device 100 are important design parameters for user convenience, the shoelace lock device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A securement device for an apparel or accessory, the securement device comprising:

a first locking component and a second locking component, wherein each of the first and second locking components have a locking element, and further wherein the locking element of the first locking component engages with the locking element of the second locking component;

the second locking components having a housing, wherein the housing is comprised with a first opening and a second opening; and a retaining pin disposed on an exterior of the housing and configured to engage a lip on the first locking component; and wherein the locking elements secure one of a lace, a string, a strap, a zip tie or a combinations thereof between the first and second locking components.

2. The securement device as recited in claim 1, wherein the first and second locking components may be raised or lowered relative to one another to allow the first and second openings to be opened or closed.

3. The securement device as recited in claim 1, wherein the first and second locking elements are cooperating threads.

4. The securement device as recited in claim 1, wherein the first and second openings in the housing are sized and configured to receive an insertion tool.

5. The securement device as recited in claim 1, wherein the second locking component is secured to the apparel or accessory.

6. The securement device as recited in claim 1, wherein the first locking component has a diameter that is different than a diameter of the second locking component.

7. The securement device as recited in claim 6, wherein the diameter of the second locking component is smaller than the diameter of the first locking component.

8. The securement device as recited in claim 6, wherein the second locking component is attached to a base which is affixed to the apparel or accessory.

9. The securement device as recited in claim 1, wherein the first locking component has a plurality of grooves in the housing.

10. A combination locking device and insertion tool comprising:

a locking device having a cap and a base, each of the cap and the base having a cooperating threaded configuration;

a housing having a first opening and a second opening;

an insertion tool having a first end and a second end, wherein one of the first and second ends is sized and configured to fit within each of the first and second openings, and further wherein the insertion tool positions one of a string, a lace, a strap, a zip tie or a combination thereof into at least one of the first and second openings; and a retaining pin disposed on an exterior of the housing and in engagement with a lip on an exterior of the cap.

11. The combination locking device and insertion tool as recited in claim 10, wherein the insertion tool has a textured end to facilitate grasping an end of the string, the lace, the strap, the zip tie or the combination thereof.

12. The combination locking device and insertion tool as recited in claim 10, wherein the cap has a diameter larger than the base such that the cap rests over the base.

13. The combination locking device and insertion tool as recited in claim 10, wherein the base is secured to a shoe and the first and second openings receive a shoelace.

14. The combination locking device and insertion tool as recited in claim 10, wherein the cap and the base have a cooperating locking feature.

15. The combination locking device and insertion tool as recited in claim 14, wherein the cooperating locking feature includes a thread or a rail.

16. The combination locking device and insertion tool as recited in claim 10, wherein the locking device comprises a retaining pin.

17. A shoelace lock device comprising:

a cap having a threaded interior, a diameter, a side surface having a plurality of grooves, and a top surface;

a housing having a base, a diameter that is less than the diameter of the cap, a threaded portion, a first opening and a second opening; and a shoelace sized and configured to fit through the first and second openings, wherein the cap is lowered onto the housing to lock the shoelace in the first and second openings, and further wherein the base is attached to a shoe; and a retaining pin disposed on an exterior of the housing and in engagement with a lip on an exterior of the cap.

18. A shoelace lock device as recited in claim 17 further comprising a shoelace insertion tool having a gripping end for inserting the shoelace through the first and second openings.

* * * * *